United States Patent [19]

Landoni

[11] Patent Number: 5,005,499

[45] Date of Patent: Apr. 9, 1991

[54] DEVICE FOR DISABLING AND ENABLING STITCHING NEEDLES IN A QUILTING MACHINE OR A MULTI-NEEDLE EMBROIDERY MACHINE

[76] Inventor: Giannino Landoni, Strada Prov. Busto-Cassano, 1, Fagnano Olona (Varese), Italy

[21] Appl. No.: 439,764

[22] Filed: Nov. 21, 1989

[30] Foreign Application Priority Data

Apr. 27, 1989 [IT] Italy ..... 20277 A/89

[51] Int. Cl.[5] ..... D05B 11/00; D05B 21/00

[52] U.S. Cl. ..... 112/117; 112/163; 112/221; 112/254

[58] Field of Search ..... 112/117, 118, 119, 102, 112/103, 221, 163, 98, 84, 78, 121.11, 121.12, 254, 255

[56] References Cited

U.S. PATENT DOCUMENTS 4,262,613 4/1981 Landoni ..... 112/118
4,501,208 2/1985 Landoni ..... 112/118
4,776,291 10/1988 Tajima et al. ..... 112/163 X

*Primary Examiner*—Peter Nerbun
*Attorney, Agent, or Firm*—Panitch Schwarze Jacobs & Nadel

[57] ABSTRACT

A device for disabling and enabling one or more needles in a quilting machine, a multi-needle embroidery machine, or the like, is described.

The device comprises a linear actuator (24) adapted to carry a needle (22) and to keep the latter, for a predetermined time, in a raised position relative to fabric (10) to be sewn.

The device includes stitching yarn (44) return means (38) being actuated when needle (22) is disabled, in order to subject to a limited tension the portion of stitching yarn located between the disabled needle and the fabric to be sewn, to prevent the yarn from becoming tangled and from breaking.

Furthermore, during the entire operating stage as mentioned above, the known yarn tensioning device (48) through which the stitching yarn is led before arriving at the needle, is disabled.

15 Claims, 3 Drawing Sheets

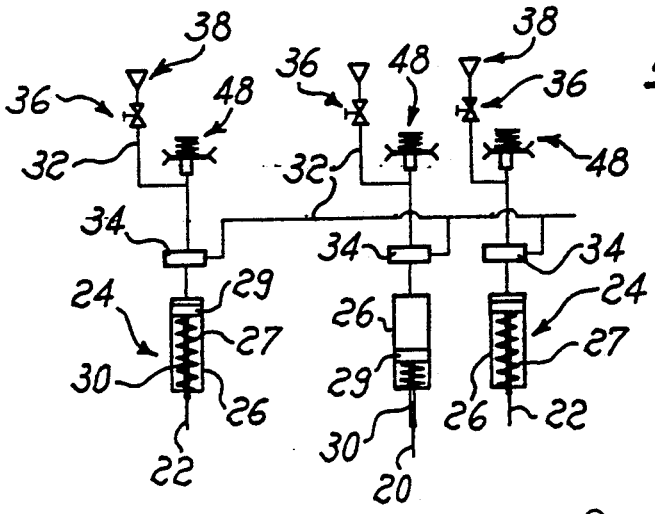
Fig. 4
Fig. 5
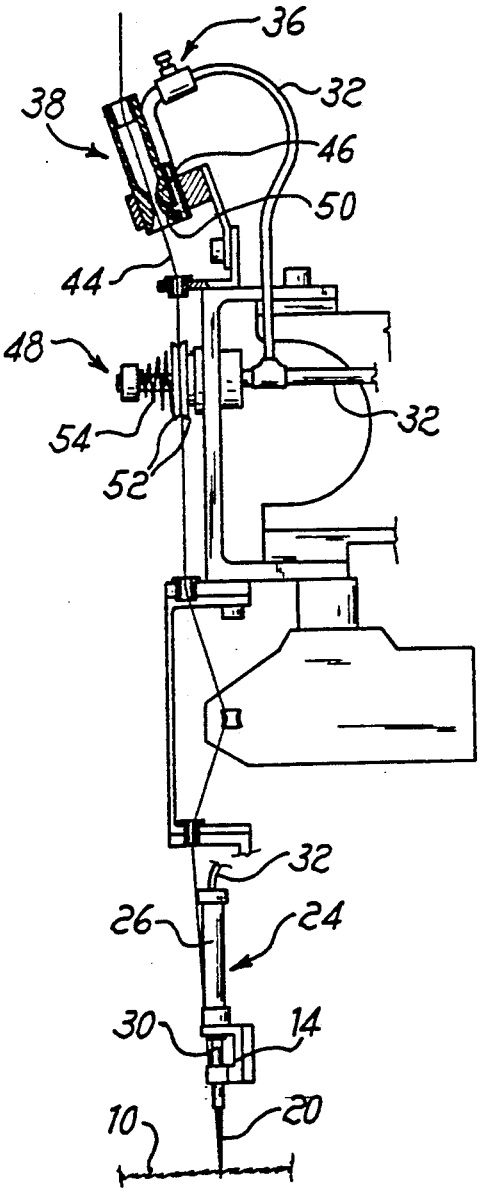
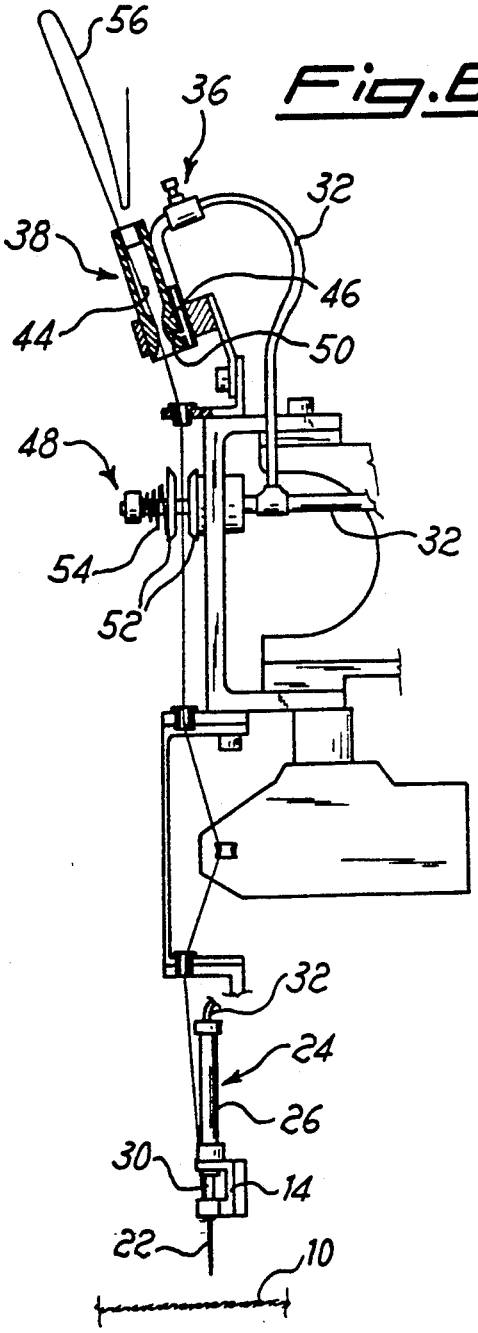
Fig. 6

DEVICE FOR DISABLING AND ENABLING STITCHING NEEDLES IN A QUILTING MACHINE OR A MULTI-NEEDLE EMBROIDERY MACHINE

This invention concerns a device for disabling or enabling one or more needles in a quilting machine, a multi-needle embroidery machine, or the like.

More particularly, the device according to this invention may be used in a quilting machine, in a multi-needle embroidery machine, i.e. in a machine provided with one or more needle-carrier bars, having each a plurality of stitching needles arranged thereon.

As it is known, quilting machines and multi-needle embroidery machines have become progressively more sophisticated, in particular after computer controlled systems have been introduced which make it possible to produce various and countless patterns which may also be obtained through variable sequences.

However, the conventional multi-needle automatic machines have drawbacks which limit their operating possibilities and therefore the performance they can provide in terms of large pattern sizes.

In fact, it is already known that, independent upon the number of needle-carrier bars and upon the number of needles on each bar, all the needles of the machine stitch the same pattern in that said needles are always enabled. Although the patterns which can be obtained are variable, according to the above mentioned programming, they depend upon two parameters only, the first being the displacement of the fabric-transport carriage while the second is the longitudinal displacement of the fabric which unrolls from, or rolls back up on the feed roll. As it is apparent, this is a non-disregardable limitation of the machines already known.

A further drawback of the conventional machines is the fact that the width of a pattern, i.e. the dimension thereof in a transverse direction relative to the fabric forwarding direction, is strongly limited by the fact that said dimension cannot exceed the extent of the transverse stroke of the fabric-transport carriage. Since the carriage sideways or transverse displacement is always a very small fraction of the fabric width, as a consequence all the patterns which may be obtained by means of the conventional machines have a very limited width compared to the fabric width, whereby it is impossible to obtain a large size panel quilting, which up to now could be produced only by means of long-arm, single-needle machines.

There has now been contrived, and it makes the subject of this invention, a device for disabling and enabling one or more needles in a quilting machine, a multi-needle embroidery machine, or the like, which does away with all the drawbacks and limitations of conventional machines.

Therefore, one of the main objects of this invention is to provide a device of the above mentioned type, by means of which, in a multi-needle machine, the stitching needles are rendered independent from each other whereby it becomes possible to disable and then to enable any number of needles, according to various programs, so that the operating possibility range of the machine is widened and the same machine may perform both conventional and panel quilting, where nowadays the latter can be provided only by means of long-arm, single-needle machines.

An additional object of this invention is to provide a device by means of which the needle enabling and disabling operations are performed while the machine itself is operating, and therefore they do not require shut-down periods which would negatively affect production times and product costs.

A further remarkable object of this invention is to provide a device of the type mentioned above, which is adapted to be associated with a predetermined number of needles and makes it possible, by suitably disabling some of said needles, to obtain patterns whose transverse dimension may be whatsoever and up to the width of the fabric to be sewn, so that an important limitation is cleared away comprising the fact that, in the known machines, the pattern width could not exceed the extent of the fabric-transport carriage transverse stroke.

The features as well as the advantages of the device according to this invention will become apparent from the following detailed description of a non limiting embodiment thereof, made in reference to the attached drawings, wherein:

FIG. 4 is a functional diagram showing the pneumatic circuit for actuating the inventive devices associated to the three needles of FIGS. 2 and 3;

FIG. 5 is a side elevational view, partially in cross section, of the device according to this invention, in the rest position, wherein the needle associated thereto is enabled;

FIG. 6 is a view similar to FIG. 5, wherein the inventive device is operating, whereby the needle associated thereto is disabled.

Figure 1:
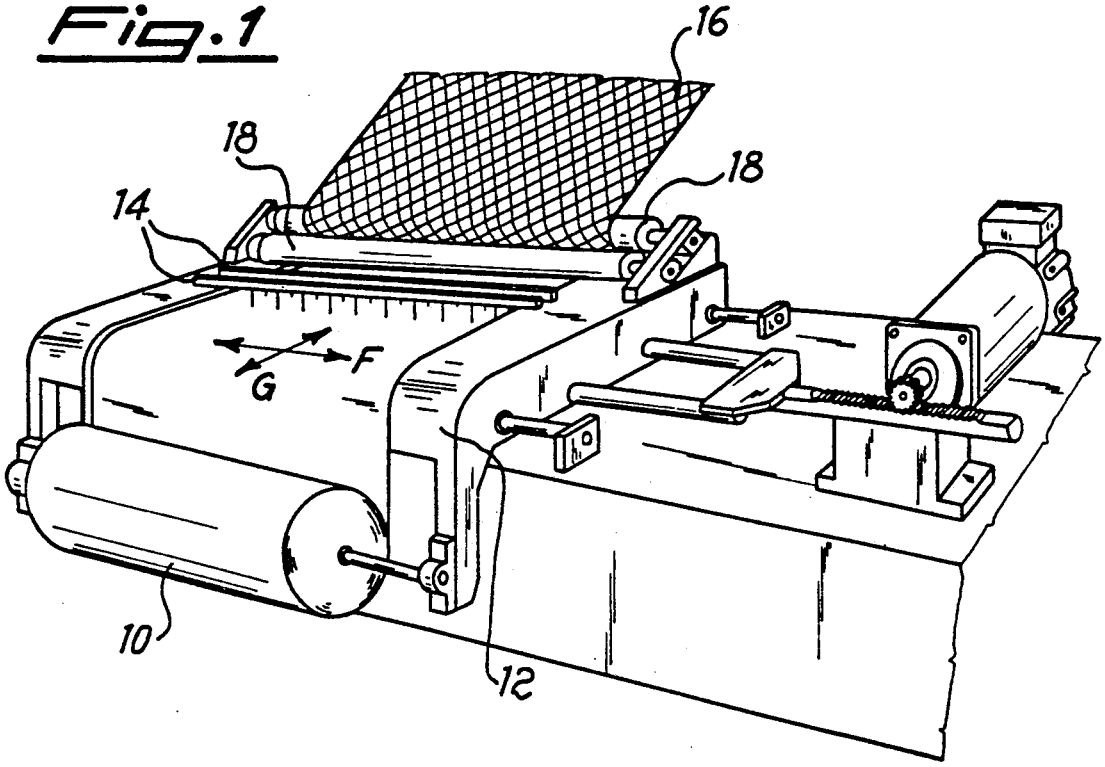
FIG. 1 is a schematic perspective view of a known multi-needle quilting machine, adapted to perform conventional quilting.

Referring now in particular to FIG. 1, there is shown therein a multi-needle quilting machine of the type, conceived by the same inventor, making the subject of Italian patent No. 1110724, filed on Feb. 9, 1979 in the name of MECA S.p.A., reference being made to the disclosure and drawings thereof in order to understand the quilting machine parts unrelated with the inventive device. It should be understood that this particular type of quilting machine has to be considered as only one of the examples of a machine to which one or more of the devices according to this invention may be applied.

Referring now to said Figure, there is shown a roll 10 comprising fabric and a padding, said roll being supported by a fabric transport carriage 12 being able to move transversely to the forwarding direction of fabric 10 to be sewn, as shown by double arrow F, under the action of the control means described in the above patent.

The fabric to be sewn may be unrolled from, and/or rolled back up on roll 10, always through the means described in the above patent, and it is made to proceed under a pair of needle-carrier bars 14 whose stitching motion is provided in a known way.

Quilted fabric 16 is led out of the machine owing to the dragging action of control rollers 18.

The quilting performed by the machine shown in FIG. 1 is conventional type, affected by the drawbacks and limitations already mentioned herein above.

Figure 1A:
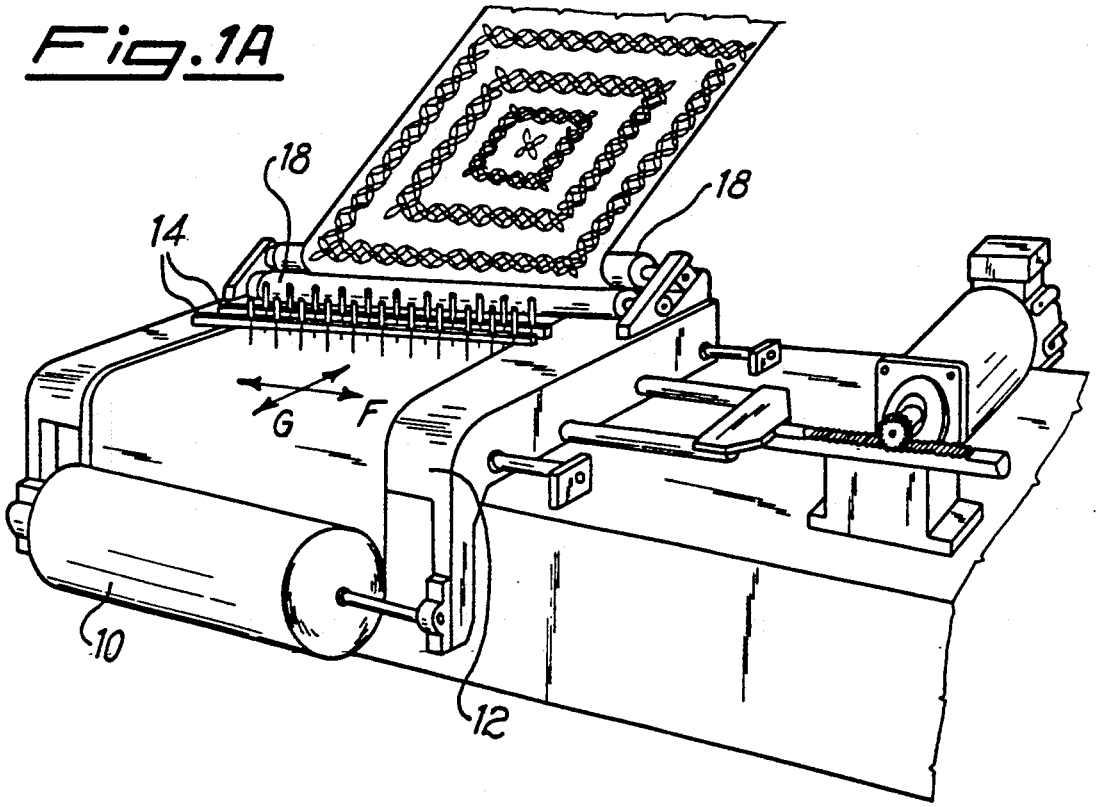
FIG. 1A shows a schematic perspective view of a multi-needle quilting machine provided, for a desired number of needles, with a device according to this invention, the Figure showing as well one of the available panel quiltings which can be obtained by means of said machine.

In FIG. 1A there is shown, in a schematic perspective view, a machine similar to FIG. 1, but provided with a plurality of devices according to this invention, making it possible to obtain a panel quilting, in particular of any desired width. It is easily observed that the outermost pattern has substantially the same width as fabric 10.

Figure 2:
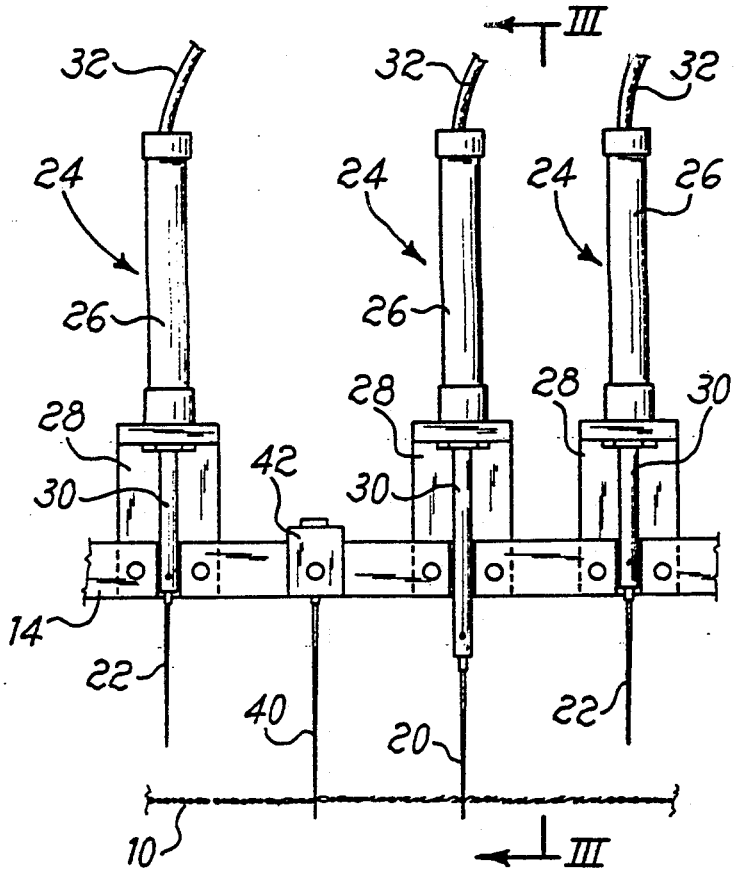
FIG. 2 is a front view of a needle-carrier bar section including three needles, two of which have been disabled by means of the device according to this invention.
Figure 3:
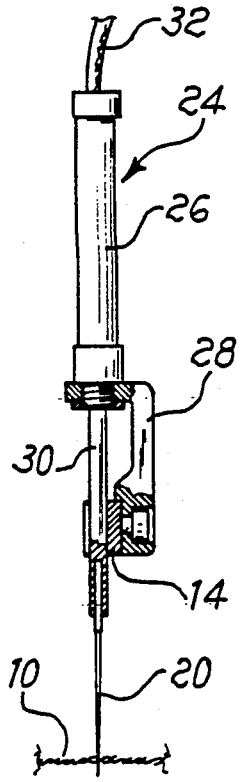
FIG. 3 shows a view of the portion of the needle-carrier bar of FIG. 2, along section line III—III of said Figure.

Referring now in particular to FIGS. 2 to 4, there is described in detail herein a preferred embodiment of the device of this invention.

In FIGS. 2 and 3 there is shown a portion of one of the needle carrier bars 14 where three stitching needles 20, 22 are arranged, among which needle 20 is operating, i.e. is enabled, while the remaining pair of needles 22 are disabled, and lie in a raised position relative to fabric 10 to be sewn.

For disabling the stitching needles, the inventive device includes a linear actuator, shown in general at 24, which is adapted to keep said needles in the raised position relative to fabric 10 to be sewn, as it is just the case for the position of needles 22.

In this embodiment, the subject linear actuator comprises a small pneumatic piston rod, whose cylinder 26 is fastened to bracket 28, which is in turn made integral with needle carrier bar 14, and a stitching needle 20 or 22 is fastened to rod 30 thereof.

The small piston rod mentioned above is suitably connected to a fluid pressure supply, not shown, and said connection and the piston rod structure are shown in FIG. 4, and they are described here in the following. The three actuators 24 are connected, through a supply duct 32, to said fluid pressure supply source and between said duct 32 and each actuator 24 there is provided a two-way control valve 34.

Still through valves 34 and through a fluid pressure flow controller 36, per se known, duct 32 supplies fluid to an ejector device 38, whose design and operation will be further explained in the following.

Referring now to FIG. 4, the unique design of the piston rods comprising linear actuator 24 is described herein. Within cylinder 26 there is arranged a spring 27, coiled up around rod 30 of the piston, being provided to keep the latter in a collapsed position within cylinder 26, whereby piston head 29 which is in engagement with spring 27 is kept in the raised position. In these conditions, needle 22 as well is raised relative to fabric 10 to be sewn, and therefore it is disabled. Spring 27 may extend whereby needle 22 is disabled due to rod 30 collapsing within cylinder 26 when two-way valve 34 is switched in such a way as to be in a closed position for actuator 24. In such a condition the fluid pressure through duct 32 cannot be supplied to said actuator.

When two-way valve 34 is switched to an open position towards actuator 24, the fluid pressure provided through duct 32 is supplied to said actuator, whereby piston head 29 is pushed downwards and simultaneously spring 27 is compressed and needle 20 is lowered and it is brought to the stitching position, i.e. it is enabled.

It can be seen from FIGS. 2 and 3 that, according to the operating possibilities of the machine, and according to user's choice, it is possible to provide any number of stitching needles 20 and 22 with linear actuator device 24, when it is desired to quilt articles like the ones shown in FIGS. 1A and 7, to be further described in the following.

Further needles, like the needle shown at 40, may be fastened to a block 42 which in turn is made integral with needle carrier bar 14. All the needles 40, fastened to needle carrier bar 14 through a block 42 will always be enabled.

A quilting machine having a number of needles provided with the linear actuators and having a plurality of stationary needles as shown at 40, has a number of operating possibilities, conventional quilting being one of them which is obtained by keeping in an enabled condition, by means of actuators 24, all the needles associated therewith. Furthermore, one or more actuators may be controlled in such a way as to disable one or more needles, when the pattern has to be modified, and said operation is convenient in that shut down of the machine to take out said one or more needles is not required. The number and the position of needles 40 to be chosen will directly depend upon the pattern one desires to obtain.

Referring now also to FIGS. 5 and 6, the inventive device includes stitching yarn return means from disabled needles 22, as it will be described in more detail herein.

Said stitching yarn return means include said ejector device 38, already mentioned in reference to FIG. 4, which in the subject embodiment comprises a converging-diverging duct 46 fastened to the machine frame in a position upstream from stitching needle 20 or 22, and also upstream from a yarn tensioner device 48 to be described in the following.

As it is shown in particular in FIGS. 4 and 6, fluid pressure is supplied from duct 32 through valve 34 when the latter is switched towards duct 46, being therefore closed in the direction of actuator 24. The fluid pressure enters into duct 46 through a passage 50 thereof, in the throat area, in order to generate a suction effect within duct 46, which is transformed into a pulling action on stitching yarn 44. The latter is then made to move backwards relative to the sewing stage forward direction, when the needle it supplies is disabled.

Still considering FIGS. 5 and 6, and as it has been already pointed out in the schematic diagram of FIG. 4, fluid pressure supply duct 32 is also connected, still through valve 34, to the yarn tensioning device 48 through which stitching yarn 44 is made to pass. Said device is known per se, but according to this invention it is provided with a small pneumatic piston rod for disabling thereof, said piston rod controlling the temporary moving apart of small discs 52 having stitching yarn 44 threaded therebetween, in order to allow the yarn to be pulled back. When a needle is enabled again, yarn tensioner device 48 is also enabled, whereby small discs 52 are kept abutting against each other by a spring 54.

Operation of the inventive device is extremely simple and reliable, as it will also be described in the following. When a stitching needle, for instance needle 20 of FIGS. 2 to 5, is operating, i.e. it is sewing, stitching yarn 44 is fed thereto in a known way, and the path thereof is shown by a substantially braided line in FIG. 5.

In this operating stage, supply valve 34 is switched towards the small piston and fluid pressure is introduced therein whereby head 29 of rod 30, and thereby rod 30 itself, are kept in a lowered position, and rod 30 keeps needle 20 in the stitching position. In said condition spring 27 is compressed.

Valve 34 is shut relative to ejector 38 and to yarn tensioner 48. Therefore, ejector 38 is disabled, while yarn tensioning device 48 is in operation.

When the stitching needle has to be disabled, i.e. it has to be brought to a raised position relative to fabric 10 to be sewn (FIG. 6), valve 34 is switched in order to stop supplying fluid pressure to the small piston rod. Rod 30 of the latter is raised, and it is kept in such a position under the action of spring 27. Switching of valve 34 communicates duct 32 with ejector device 38 and yarn tensioner 48. Ejector 38 is actuated while the yarn tensioner is disabled, making it possible to pull back yarn 44 which is still shown with a braided line in FIG. 6. As it is apparent in said Figure, upstream from duct 46, owing to the suction generated therein, stitching yarn 44 has been pulled back from stitching needle 22 and it forms a loop 56, the latter being kept in the position shown under the blowing action of the pressure fluid introduced into duct 46. It should be apparent that the size of loop 56 depends directly upon the amount of yarn to be pulled back from needle 22, and in any case it will be such as to generate in the portion of yarn 44 lying between needle 22 and fabric 10 to be sewn, a certain amount of tension sufficient to avoid formation of a surplus amount of yarn between needle 22 and fabric 10, which might otherwise interfere with other active needles performing the sewing operation, with a possible breakage of the subject yarn.

When one or both needles 22 have to be enabled again, it is sufficient to switch again valve or valves 34, in order to resume supplying fluid pressure to piston rods 26 associated therewith, whereby rods 30 are brought back to the lowered position thereof, corresponding to the enabled sewing position. Stitching yarn 44 will correspondingly proceed to the condition shown in FIG. 5, in that both the suction action and the blowing action within duct 46 have been interrupted. Yarn 44, recalled by the sewing action, proceeds towards needle 20 under a tension controlled by device 48.

As it should be apparent, the embodiment described above in reference to the attached Figures showing the linear actuator 24 is an exemplary embodiment of the subject device, which might be of a different design and still fulfill the same purpose.

For instance, said linear actuator might conveniently comprise an electromagnet fastened to needle-carrier bar 14 and provided with a movable armature having the needle to be disabled fastened thereto.

According to a further convenient embodimental variation, the linear actuator is associated to a portion of the needle-carrier bar, in order to make it possible to simultaneously disable or enable again a plurality of needles being each fastened to said portion of the needle-carrier bar by means of a block 42.

In this embodimental variation, the stationary part of the linear actuator, i.e. cylinder 26 or the electromagnet, are fastened to the machine frame, while the linear actuator moving portion i.e. rod 30 or the electromagnet moving armature, are fastened to said portion of the needle-carrier bar.

Based on what has been described above, the advantages obtained by using a quilting machine provided with a plurality of devices according to this invention should be apparent.

Said advantages are emphasized by the example described here in the following.

Figure 7:
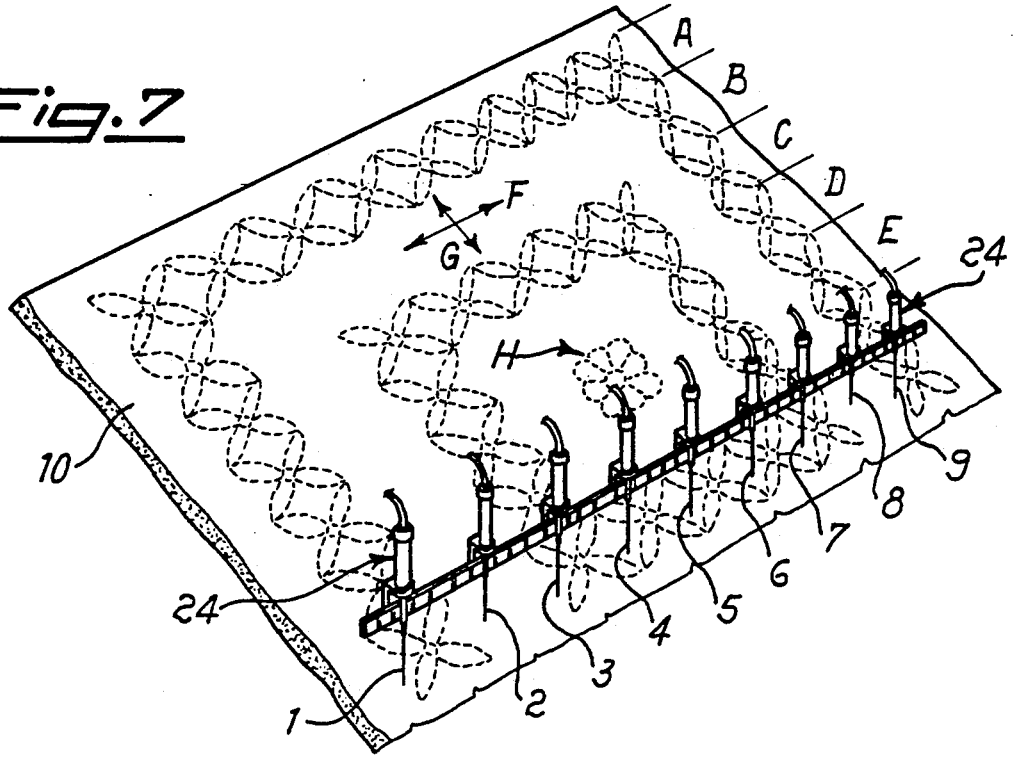
FIG. 7 shows one of the further panel quiltings available through the use of a machine provided with a predetermined number of devices according to this invention.

By programming a suitable sequence of actuator controlled needles, it is possible to obtain large size panel quiltings and intermediate stitching-free areas, as it is shown in FIG. 7. There is provided nine needles, referenced by numbers 1 to 9, each being provided with its own actuator 24.

The stitching cycle is the following:

Needles number 1-2-3-4-5-6-7-8-9 enabled to perform quilting in area A, by using a programmed displacement of carriage 12 and of forwarding rollers 18;

Needles number 1–9 enabled and needles number 2-3-4-5-6-7-8 disabled, in order to perform quilting in area B, by using a programmed displacement of carriage 12 and of forwarding rollers 18;

Needles number 1-3-4-5-6-7-9 enabled and needles 2–8 disabled in order to perform quilting in area C, by using a programmed displacement of carriage 12 and of forwarding rollers 18;

Needles number 1-3-7-9 enabled and needles 2-4-5-6-8 disabled in order to perform quilting in area D, by using the programmed displacement of carriage 12 and of forwarding rollers 18;

Needles 1-3-7-9 enabled and needles number 2-4-5-6-8 disabled in order to perform quilting in area E, by using the programmed displacement of carriage 12 and of forwarding rollers 18;

Needle number 5 enabled and needles number 1-2-3-4-6-7-8-9 disabled, in order to perform quilting in the central area H by using the programmed displacement of carriage 12 and of forwarding rollers 18.

The above sequences are continued in reverse, in order to complete the quilting. The whole cycle described above is programmed and automatically controlled by the machine control computer making the subject of a previous patent of the same inventor.

One of the main advantages provided by the machine according to this invention is the possibility to obtain patterns having whatsoever size in a direction transverse relative to the forwarding direction of the material to be sewn, up to a maximum size equal to the width thereof. That is made possible by performing the stitching operations on one side of the pattern according to said transverse direction, and continuing afterwards, according to the pattern outline, by disabling in turn, all or part of the needles lying between the two end needles of a needle carrier bar, or of both.

A further advantage is obtained in that needle disabling and enabling operations are performed while the machine is operating, and said operations may be computerized, whereby the machine process velocity is very high.

Eventually, it should be understood that variations and/or modifications may be made to the device according to this invention, without exceeding the scope of protection of this invention.

I claim:

1. A device for disabling and enabling one or more stitching needles in a machine provided with at least one needle-carrier bar having a plurality of stitching needles arranged thereon characterized in that it comprises a linear actuator (24) for disabling a needle (22), adapted to control the raising thereof relative to fabric

(10) to be sewn, and to keep it in said position, and return means (38) for stitching yarn (44) of the disabled needle (22), adapted to subject to a limited tension the portion of the stitching yarn lying between the disabled needle (22) and fabric (10) to be sewn, said stitching yarn return means being enabled simultaneously to the disabling of a yarn tensioning device (48) which was operating when the disabled stitching needle (22) was sewing.

2. The device of claim 1, characterized in that said disabling linear actuator (24) is a pneumatic piston having a cylinder (26) which is fastened to a needle carrier bar (14), said cylinder having a piston rod (30) onto which the stitching needle to be disabled is fastened.

3. The device of claim 1, characterized in that said disabling linear actuator (24) is an electromagnet fastened to needle-carrier bar (14) and provided with a moving armature carrying the needle to be disabled fastened thereto.

4. The device of claim 2, characterized in that, within cylinder (26) there is provided resilient means (27) adapted to control the partial collapsing of a rod (30) of the pneumatic piston inside cylinder (26), causing needle (22), fastened to said rod, to be raised relative to fabric (10) to be sewn.

5. The device of claim 2, characterized in that said pneumatic piston may be connected to a supply source of pressurized fluid, and when the latter is admitted to cylinder (26), it causes piston rod (30) to extend out of said cylinder with a simultaneous compression of said resilient means (27), the stitching needle fastened to said rod (30) being then brought to the stitching position.

6. The device of claim 1, characterized in that said stitching yarn return means, relative to the disabled needle (22) include an ejector device (38) located upstream from said needle, and connectable to a supply source of pressurized fluid, through which stitching yarn (44) is made to pass, whereby said ejector device (38) subjects said stitching yarn (44) to a pulling action because of a suction effect, and said yarn is pulled back in a direction opposite to the feeding direction for sewing.

7. The device of claim 6, characterized in that said ejector device (38) is a duct having a converging-diverging section (46), and fluid pressure is admitted therewithin.

8. The device of claim 1, characterized in that said yarn tensioning device is provided with a small pneumatic piston rod, the latter being subjected to fluid pressure simultaneously with said ejector device.

9. The device of claim 5, characterized in that, for each linear actuator (24), a two-way valve (34) is provided in the fluid pressure supply circuit, said valve being adapted to control alternate feeding of said fluid only to pneumatic piston cylinder (26) or to ejector (38) and to yarn tensioning device (48).

10. The device of claim 1, characterized in that said linear actuator (24) is associated with a portion of the needle-carrier bar, whereby it can simultaneously disable or enable a plurality of needles.

11. The device of claim 10, characterized in that said linear actuator has a part thereof fastened to a quilting machine frame, and a moving element connected to said portion of the needle-carrier bar (14).

12. The device of claim 4, characterized in that said pneumatic piston may be connected to a supply source of pressurized fluid, and when the latter is admitted to said cylinder (26), it causes piston rod (30) to extend out of said cylinder with a simultaneous compression of said resilient means (27), the stitching needle fastened to said rod (30) being then brought to the stitching position.

13. The device of claim 6, characterized in that said yarn tensioning device is provided with a small pneumatic piston rod, the latter being subjected to fluid pressure simultaneously with said ejector device.

14. The device of claim 6, characterized in that, for each linear actuator (24), a two-way valve (34) is provided in the fluid pressure supply circuit, said valve being adapted to control alternative feeding of said fluid only to said pneumatic piston cylinder (26) or to said ejector (38) and to said yarn tensioning device (48).

15. The device of claim 8, characterized in that, for each linear actuator (24), a two-way valve (34) is provided in the fluid pressure supply circuit, said valve being adapted to control alternate feeding of said fluid only to said pneumatic piston cylinder (26) or to said ejector (38) and to said yarn tensioning device (48).

* * * * *